US008107850B2

(12) United States Patent
Xu et al.

(10) Patent No.: US 8,107,850 B2
(45) Date of Patent: Jan. 31, 2012

(54) DEVELOPING DEVICE

(75) Inventors: Fan Xu, Nagoya (JP); Yuichi Matsushita, Nagoya (JP); Yoshinori Ito, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 552 days.

(21) Appl. No.: 12/361,921

(22) Filed: Jan. 29, 2009

(65) Prior Publication Data

US 2009/0190952 A1 Jul. 30, 2009

(30) Foreign Application Priority Data

Jan. 29, 2008 (JP) ..... 2008-017260

(51) Int. Cl.
*G03G 15/08* (2006.01)

(52) U.S. Cl. ..... 399/103; 399/284

(58) Field of Classification Search ..... 399/103, 399/105, 274, 284, 272, 273, 281, 283
See application file for complete search history.

(56) References Cited

U.S. PATENT DOCUMENTS 4,566,402 A * 1/1986 Shimazaki ..... 399/284
5,870,651 A * 2/1999 Shimada ..... 399/103
6,021,299 A * 2/2000 Hansburg et al. ..... 399/284
6,253,052 B1 * 6/2001 Cornelius et al. ..... 399/274
6,356,723 B1 3/2002 Sato et al.
6,459,867 B2 * 10/2002 Ohgoshi et al. ..... 399/103

FOREIGN PATENT DOCUMENTS

| | | |
|---|---|---|
| JP | 10-307474 | 11/1998 |
| JP | 11-084870 | 3/1999 |
| JP | 2001-134080 | 5/2001 |
| JP | 3105832 | 9/2004 |
| JP | 3125105 | 8/2006 |

* cited by examiner

*Primary Examiner* — Susan Lee
(74) *Attorney, Agent, or Firm* — Banner & Witcoff, Ltd.

(57) ABSTRACT

A developing device is provided. The developing device includes a housing, a developing agent carrier, and a developing agent leakage prevention member. The developing agent leakage prevention member has a first layer that is configured to contact an outer circumferential surface of a longitudinal end of the developing agent carrier; a second layer that is superimposed on the first layer and is configured to contact a portion of the housing; and an adhesive layer that is interposed between the first layer and the second layer, the adhesive layer partially bonding a first opposing surface of the first layer opposing the second layer to a second opposing surface of the second layer opposing the first layer such that an unbonded area where the first opposing surface and the second opposing surface are not bonded together is produced.

6 Claims, 7 Drawing Sheets

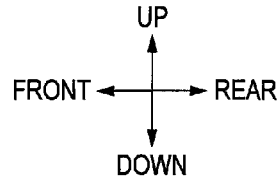
FIG. 6A
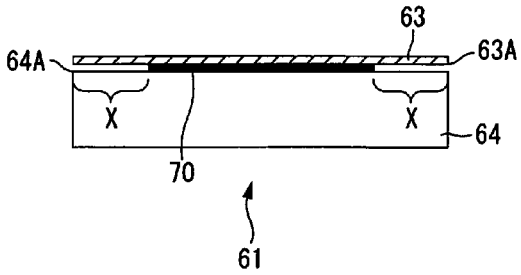
FIG. 6B
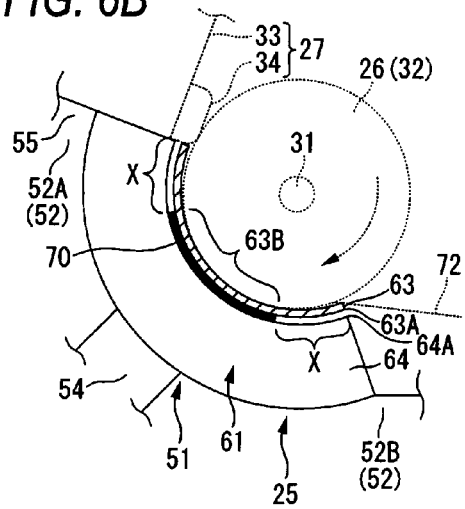
FIG. 6C
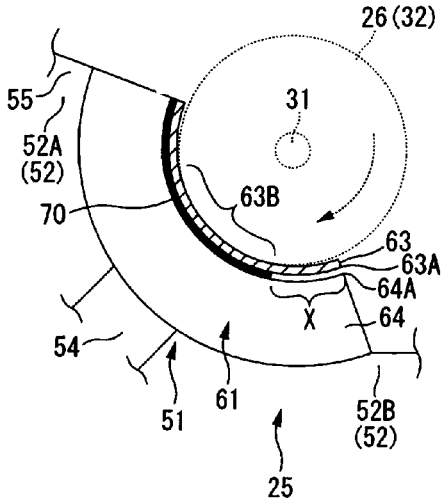
FIG. 6D
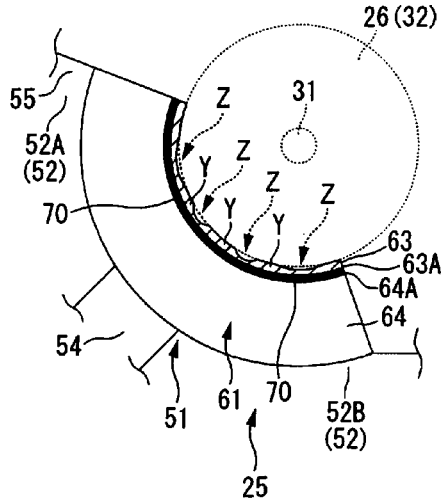

DEVELOPING DEVICE

CROSS REFERENCE TO RELATED APPLICATION

The present application claims priority from Japanese Patent Application No. 2008-017260, which was filed on Jan. 29, 2008, the disclosure of which is herein incorporated by reference in its entirety.

TECHNICAL FIELD

Devices consistent with the present invention relate to a developing device incorporated in an electrophotographic image forming apparatus.

BACKGROUND

Japanese unexamined patent application publication No. JP-A-2001-134080 (Patent Document 1) describes a related art image forming apparatus. For instance, a laser beam printer described as an electrophotographic image forming apparatus in Patent Document 1 is equipped with a developing device that develops an electrostatic latent image produced on a photosensitive drum into a visible toner image. The developing device has a case that stores toner and has an opening formed therein and a developing roller that is rotatably supported by the case so as to face the opening and that supplies toner to the photosensitive drum.

The developing device has a developing agent leakage prevention member for preventing leakage of toner from both ends of a developing roller. The developing agent leakage prevention member includes a side seal layer made of sponge and a fluorine-based felt layer. The side seal is attached to side seal attachment areas opposing respective longitudinal ends of the developing roller in the case by means of a double-sided tape so as to curve along an outer circumferential surface of the developing roller. In this state, the fluorine-based felt is attached to the side seals by means of the double-sided tape, to thus curve as do the side seals. The side seals form base portions of the developing agent leakage prevention member.

In such a developing agent leakage prevention member, the fluorine-based felt remains in close contact with both ends of the outer circumferential surfaces of the developing roller by means of elasticity of the side seals. Therefore, since the fluorine-based felt comes into slidable contact with both ends of the outer circumferential surface of the rotating developing roller, leakage of toner from both ends of the developing roller is prevented.

SUMMARY

In the developing device described in Patent Document 1, the fluorine-based felt and the side seal differ from each other in terms of a physical property (a distortion characteristic, and the like) and hence also differ from each other in terms of the amount of deformation stemming from a curvature. When the entire faces of the fluorine-based felt facing the side seal and the surfaces of the side seals opposing the fluorine-based felt are bonded together despite the facts, wrinkles can arise in the area of the fluorine-based felt contacting the outer circumferential surface of the developing roller under influence of deformation of the side seals forming the base portions of the developing agent leakage prevention member. In particular, the side seals and the fluorine-based felt become further curved (deformed) when the diameter of the developing roller becomes smaller in accordance with miniaturization of the developing device; hence, a greater number of wrinkles are likely to arise in the fluorine-based felt. When the wrinkles occur as mentioned above, a gap develops between the fluorine-based felt and the outer circumferential surface of the developing roller, and toner may leak out from the outer circumferential surfaces of the developing roller by way of the gap.

When the entire surfaces of the fluorine-based felt opposing the side seals are bonded to the surfaces of the side seals opposing the fluorine-based felt by means of a double-sided tape, efforts are consumed by attaching the developing agent leakage prevention member to the case of the developing device.

An objective of the present invention is to provide a developing device that enables easy attachment of a developing agent leakage prevention member while preventing occurrence of wrinkles in a layer of the developing agent leakage prevention member contacting an outer circumferential surface of a developing agent carrier, to thus prevent leakage of a developing agent from the outer circumferential surface of the developing agent carrier.

According to the exemplary embodiment of the present invention, there is provided a developing device comprising: a housing that stores developing agent and has an opening; a developing agent carrier that is rotatably supported by the housing, the developing agent carrier holding the developing agent on an outer circumferential surface of the developing agent carrier; a developing agent leakage prevention member that is provided in the housing outside the opening in a longitudinal direction of the developing agent carrier, the developing agent leakage prevention member preventing leakage of the developing agent from a space between an opposing area of the housing opposing a longitudinal end of the developing agent carrier and an outer circumferential surface of the longitudinal end of the developing agent carrier, wherein the developing agent leakage prevention member comprising: a first layer that is configured to contact the outer circumferential surface of the longitudinal end of the developing agent carrier; a second layer that is superimposed on the first layer and is configured to contact the opposing area of the housing; and an adhesive layer that is interposed between the first layer and the second layer, the adhesive layer partially bonding a first opposing surface of the first layer opposing the second layer to a second opposing surface of the second layer opposing the first layer such that an unbonded area where the first opposing surface and the second opposing surface are not bonded together is produced.

According to the present invention, the developing agent leakage prevention member, which prevents leakage of developing agent from an outer circumferential surface of a longitudinal end of the developing agent carrier, has a first layer that contacts the outer circumferential surface of the longitudinal end of the developing agent carrier; a second layer that contacts the opposing area opposing the longitudinal end of the developing agent carrier in the housing; and an adhesive layer interposed between the first layer and the second layer. The second layer contacting the opposing area of the housing form a base portion of the developing agent leakage prevention member. The developing agent leakage prevention member is interposed between the outer circumferential surface of the developing agent carrier and the opposing area and becomes deformed along the outer circumferential surface of the developing agent carrier.

BRIEF DESCRIPTION OF THE DRAWINGS

Illustrative aspects of the invention will be described in detail with reference to the following figures wherein:

FIGS. 5A through 5C are rear views of the developing cartridge, wherein FIG. 5A shows a development frame (in a state where the developing roller and the layer thickness regulation blade are removed), FIG. 5B shows the layer thickness regulation blade, and FIG. 5C shows a developing roller;

FIGS. 6A to 6D are schematic cross-sectional views of a side seal, wherein FIG. 6A shows a state achieved before attachment of the side seal to the development frame, FIG. 6B shows a state (an exemplary embodiment) achieved after the side seal has been attached to the development frame, FIG. 6C shows a state (a modification) in which the side seal is attached to the development frame, and FIG. 6D shows a state (a comparative example) in which the side seal is attached to the development frame.

DETAILED DESCRIPTION OF EXEMPLARY EMBODIMENTS OF THE PRESENT INVENTION

1. Laser Printer

Figure 1:
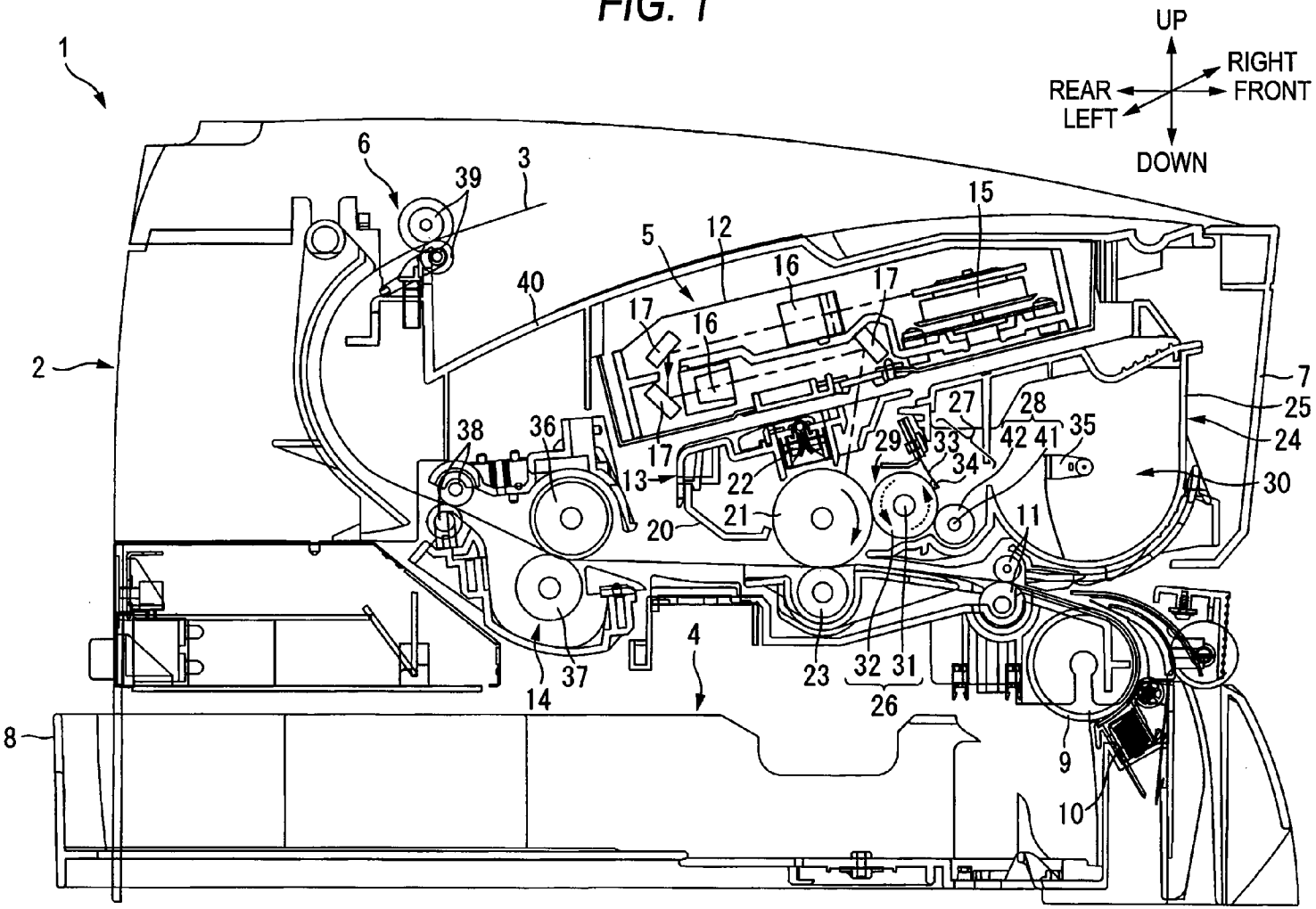
FIG. 1 is a side cross-sectional view showing an exemplary embodiment of a laser printer serving as an example of an image forming apparatus of the present invention.

FIG. 1 is a side cross-sectional view showing an exemplary embodiment of a laser printer serving as an example of an image forming apparatus of the present invention.

In FIG. 1, the laser printer 1 has a sheet feeding unit 4 for feeding a sheet 3; an image forming unit 5 for producing an image on the thus-fed sheet; and a sheet discharge unit 6 for discharging the sheet 3 having the thus-produced image, all of which are provided within a main body casing 2.

(1) Main Body Casing

The main body casing 2 is produced so as to have the shape of a box, and a release port is opened in one sidewall of the casing. There is provided a front cover 7 for opening and closing the release port. By opening the front cover 7, it is possible to remove or attach a process unit 13 (which will be described later) or a developing cartridge 24 (which will be described later in a case where a process unit 13 is attached to the main body casing 2), which serves as an example of a developing device, from or to the main body casing 2.

In the following descriptions, a side of the laser printer provided with the front cover 7 is taken as a forward side (a front side), and an opposite side of the forward side is taken as a backward side (a rear side). Further, a side of the printer proximate to the viewer with respect to the thickness direction of a sheet in FIG. 1 is taken as a left side, and a deep inside of the printer with respect to the thickness direction of the sheet in FIG. 1 is taken as a right side. A lateral direction is synonymous with a widthwise direction.

Further, directions relating to the process unit 13 and a developing cartridge 24 are also determined with reference to a state achieved when the unit and the cartridge are attached to the main body casing 2.

(2) Sheet Feeding Unit

The sheet feeding unit 4 has a sheet feed tray 8, a sheet feed roller 9, a separation pad 10, and a registration roller 11.

The sheets 3 are stacked in the sheet feeding tray 8. The topmost sheet 3 in the sheet feeding tray 8 is sorted one at a time by the sheet feed roller 9 and the separation pad 10 and conveyed to the registration roller 11. Subsequently, the sheet 3 is conveyed to a transfer position of the image forming unit 5 (which will be described later) by means of the registration roller 11.

(3) Image Forming Unit

The image forming unit 5 has a scanner unit 12, a process unit 13, and a fixing unit 14.

(a) Scanner Unit

The scanner unit 12 is placed at an elevated position within the main body casing 2 and has a laser emission unit, a polygon mirror 15, a plurality of lenses 16, and a plurality of reflection mirrors 17.

As indicated by an illustrated dashed line, a laser beam that is emitted from the laser emission unit and that is based on image data is reflected by the polygon mirror 15 and passes through the plurality of lenses 16 and undergoes reflection on the plurality of reflection mirrors 17, thereby scanning the surface of a photosensitive drum 21 of the process unit 13.

(b) Process Cartridge

The process unit 13 is placed beneath the scanner unit 12 within the main body casing 2 and removably attached to the main body casing 2.

The process unit 13 has the photosensitive drum 21, a scorotoron charger 22, a transfer roller 23, and a developing cartridge 24, all of which are built in a process frame 20.

The photosensitive drum 21 is long in its widthwise direction and rotatably supported by the process frame 20. The scorotoron charger 22 is supported, at a position above the photosensitive drum 21, by the process frame 20 while remaining spaced apart from the photosensitive drum 21. The transfer roller 23 is positioned below and opposite the photosensitive drum 21 and rotatably supported by the process frame 20.

The developing cartridge 24 is removably attached to the process frame 20.

The developing cartridge 24 has a developing roller 26 serving as an example of a developing agent carrier, a layer thickness regulation blade 27 serving as an example of a regulation member, and a supply roller 28, all of which are built in a development frame 25 serving as an example of a housing. The development frame 25 is formed so as to have the shape of a box whose rear side is provided with an opening 29, and a toner storage chamber 30 is formed forward of the supply roller 28.

The developing roller 26 is longitudinal in its widthwise direction. The developing roller 26 is positioned in the opening 29 opposite the photosensitive drum 21 so as to become exposed rearwardly and rotatably supported by the development frame 25. Specifically, the developing roller 26 has a metal developing roller shaft 31 rotatably supported by the development frame 25 and a rubber roller 32 that covers the developing roller shaft 31 and that is formed from conductive rubber.

The layer thickness regulation blade 27 has a leaf spring member 33 formed so as to have the shape of a thin plate and pressure contact rubber 34 provided at a lower end of the leaf spring member 33. An upper end of the leaf spring member 33 is fastened to the development frame 25, and the pressure contact rubber 34 remains in pressed contact with the surface of the rubber roller 32 by means of elastic force of the leaf spring member 33.

The supply roller 28 is longitudinal in its widthwise direction. The supply roller 28 is positioned opposite and forward of the developing roller 26 and has a metal supply roller shaft 41 rotatably supported by the development frame 25 and a sponge roller 42 that covers the supply roller shaft 41 and that is made of conductive sponge.

Nonmagnetic, monocomponent, positively-charged, polymerized toner is stored as an example of a developing agent in the toner storage chamber 30. The polymerized toner is substantially spherical and exhibits superior fluidity. An agitator 35 is provided in the toner storage chamber 30.

The toner in the toner storage chamber 30 is agitated by rotation of the agitator 35 and supplied to the supply roller 28. Subsequently, the toner is supplied to the developing roller 26 by rotation of the supply roller 28. At this time, the toner is positively charged by friction between the supply roller 28 and the developing roller 26. Subsequently, the toner enters a space between the pressure contact rubber 34 of the layer thickness regulation blade 27 and the rubber roller 32 along with rotation of the developing roller 26. The toner is held in the form of a thin layer on the surface of the rubber roller 32 (i.e., an outer circumferential surface of the developing roller 26) while undergoing regulation in terms of a layer thickness between the rubber and the rubber roller. As mentioned above, the layer thickness regulation blade 27 regulates the thickness of the toner held on the outer circumferential surface of the developing roller 26.

In the meantime, the surface of the photosensitive drum 21 is first uniformly, positively charged by the scorotoron charger 22 along with rotation of the photosensitive drum 21 and then exposed to a laser beam from the scanner unit 12. Thereby, an electrostatic latent image based on image data is produced on the surface of the photosensitive drum 21. Next, when the toner held on the surface of the rubber roller 32 contacts opposite the photosensitive drum 21 by rotation of the developing roller 26, the toner is supplied to the electrostatic latent image produced on the surface of the photosensitive drum 21. The electrostatic latent image is thereby developed (visualized), and a toner image is held on the surface of the photosensitive drum 21. The toner image is transferred onto the sheet 3 conveyed to a position (a transfer position) between the photosensitive drum 21 and the transfer roller 23.

(c) Fixing Unit

The fixing unit 14 is placed at a rearward position with respect to the process unit 13. The fixing unit 14 has a heating roller 36 and a press roller 37 brought into pressed contact with the heating roller 36 from below.

The fixing unit 14 subjects the toner transferred on the sheet 3 at the transfer position to heat fusing in the course of the sheet 3 passed between the heating roller 36 and the press roller 37.

(4) Sheet Discharge Unit

The sheet discharge unit 6 has a conveyance roller 38, a sheet discharge roller 39, and a sheet discharge tray 40. The thermally-fused sheet 3 is conveyed to the sheet discharge roller 39 by the conveyance roller 38 and output onto the sheet discharge tray 40 by the sheet discharge roller 39.

2. Details of Developing Cartridge

Figure 2:
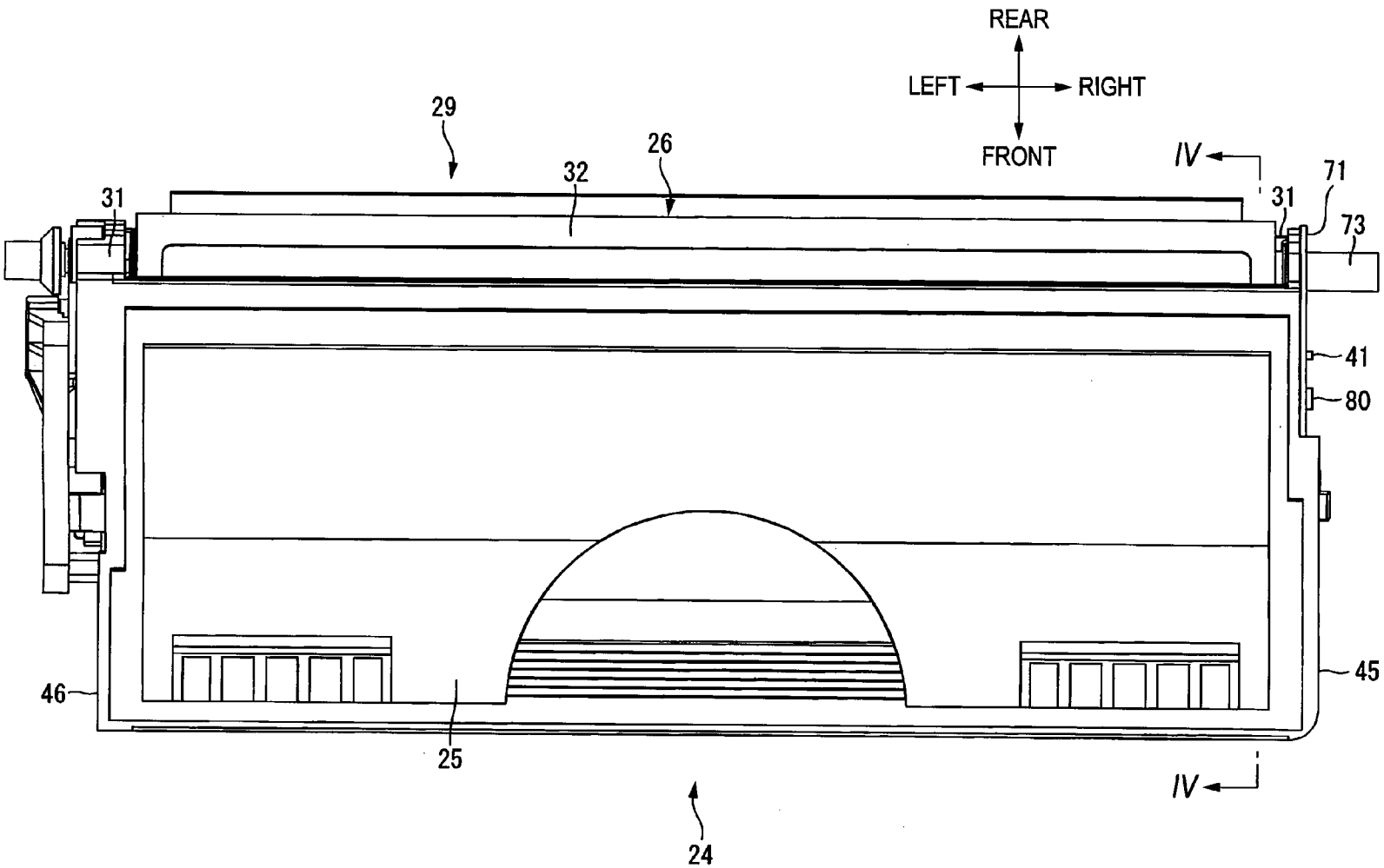
FIG. 2 is a plan view of a developing cartridge.
Figure 3:
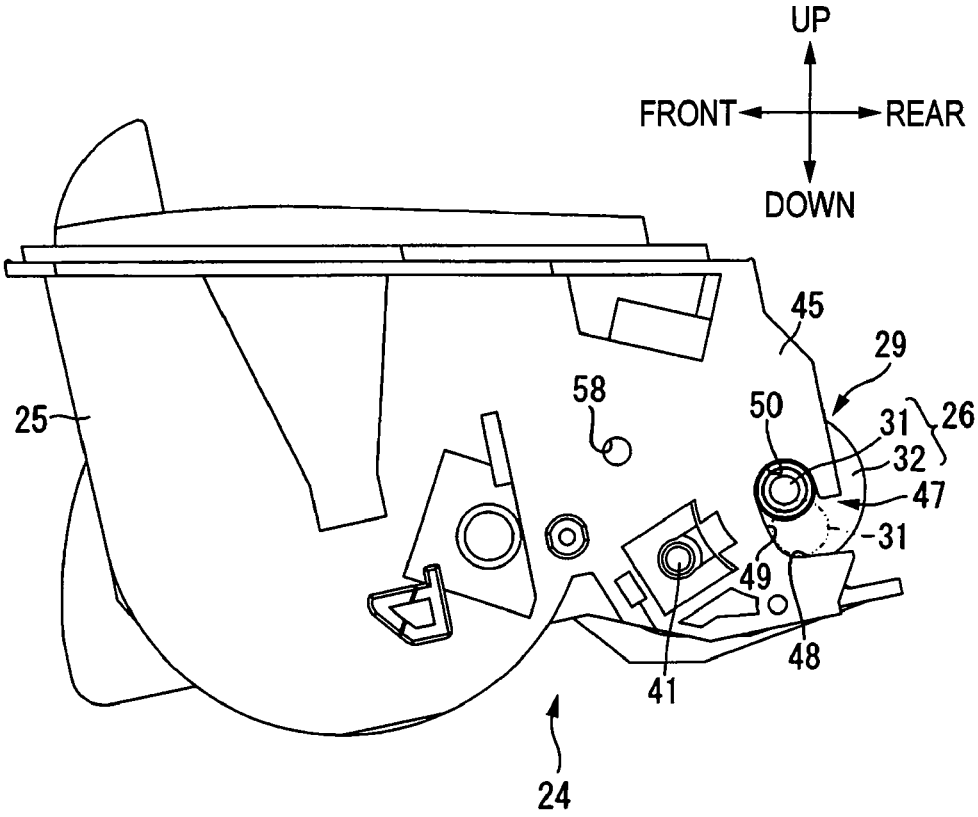
FIG. 3 is a right side view of the developing cartridge (in a state where a bearing member is removed)
Figure 4:
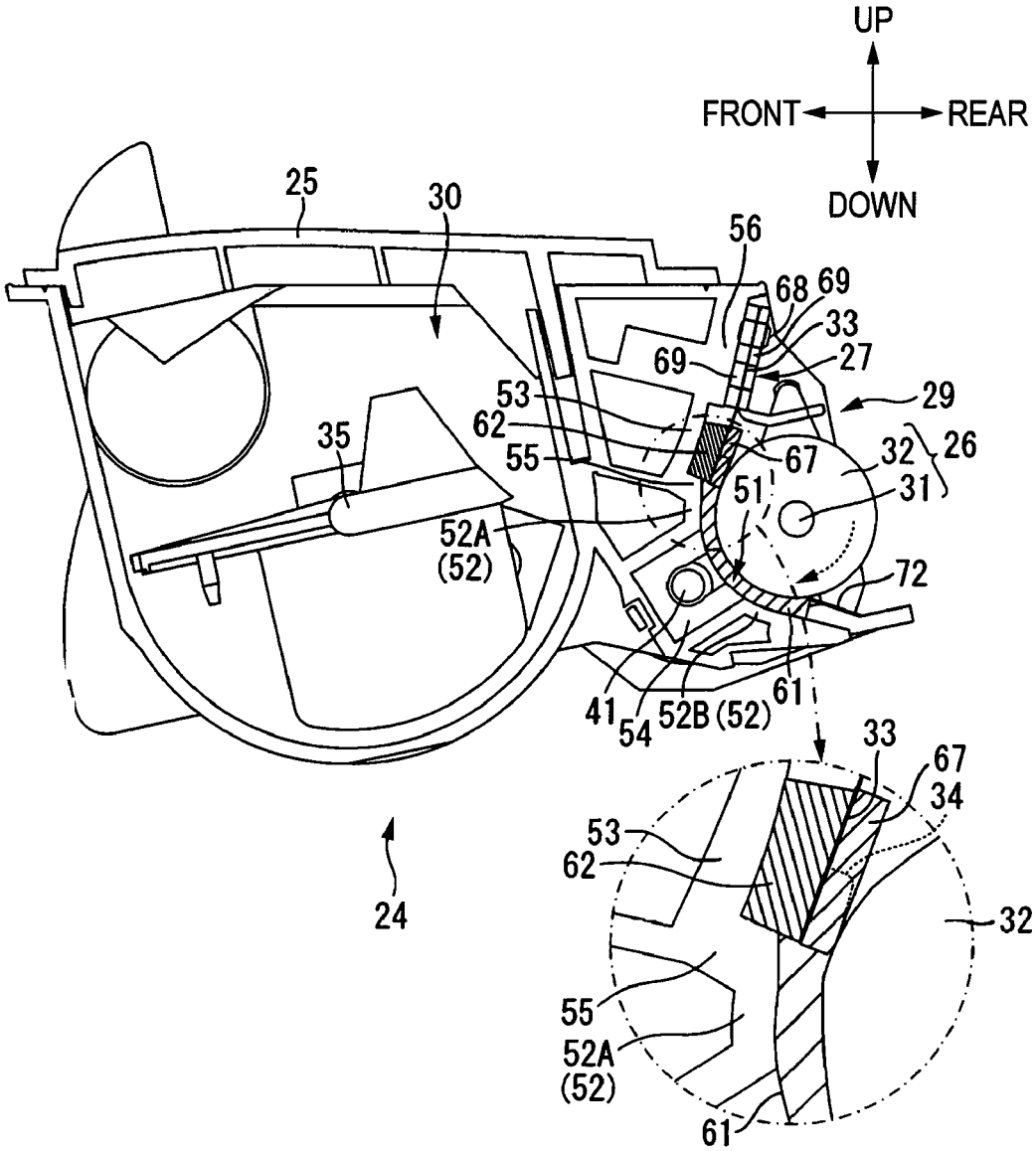
FIG. 4 is a cross-sectional view taken along line IV-IV shown in FIG. 2.
Figures 5A, 5B, 5C:
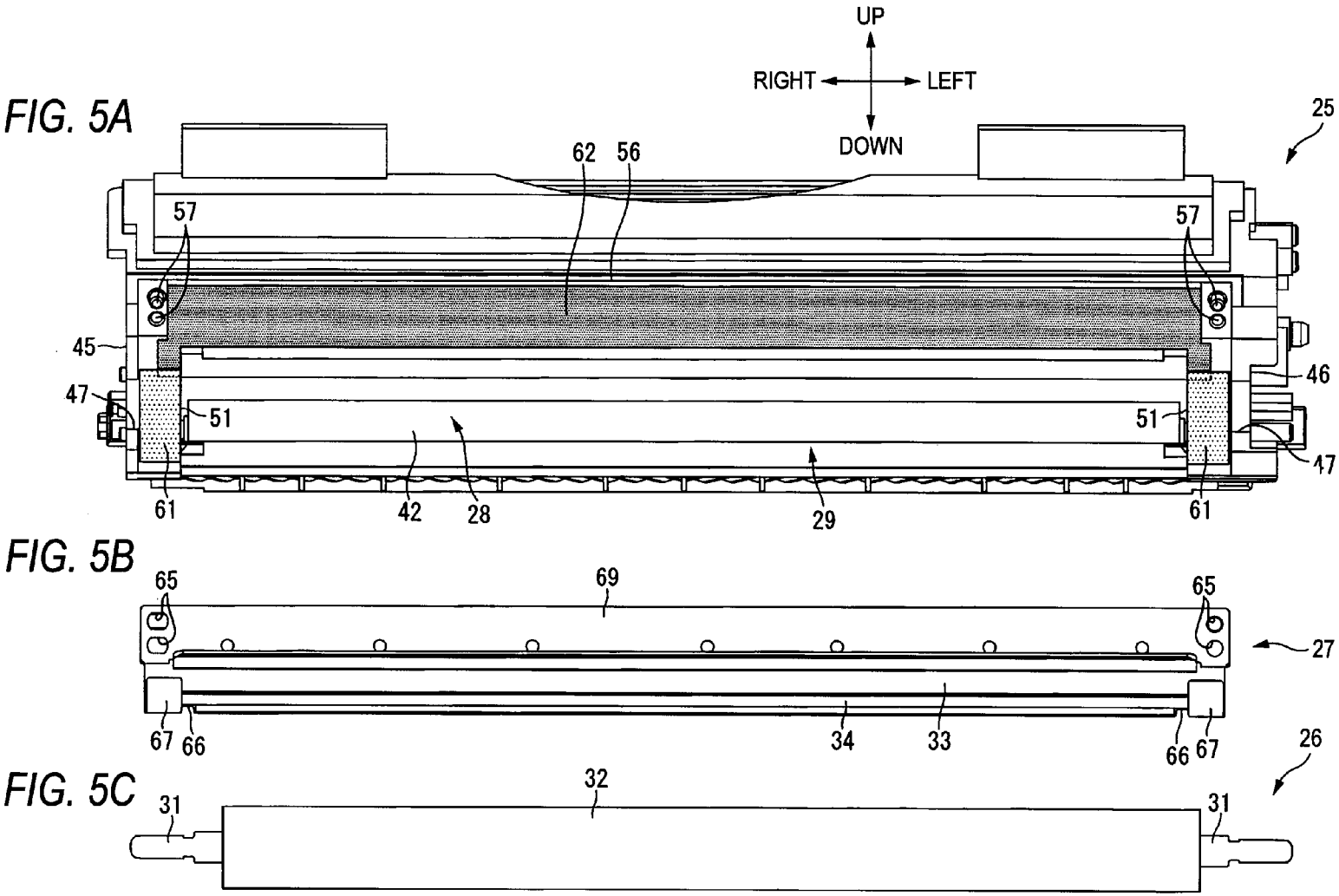

FIG. 2 is a plan view of a developing cartridge. FIG. 3 is a right side view of the developing cartridge (in a state where a bearing member is removed). FIG. 4 is a cross-sectional view taken along line IV-IV shown in FIG. 2. FIGS. 5A through 5C are rear views of the developing cartridge. FIG. 5A shows a development frame (in a state where the developing roller and the layer thickness regulation blade are removed). FIG. 5B shows the layer thickness regulation blade. FIG. 5C shows a developing roller.

In the following descriptions, the direction of rotation of the developing roller 26 corresponds to, as indicated by arrows of dotted lines in FIG. 1, a direction in which an area of the developing roller 26 opposing the supply roller 28 later opposes in sequence the layer thickness regulation blade 27 and the photosensitive drum 21. An upstream position and a downstream position of the developing roller 26 in its direction of rotation represent a relative positional relationship between two positions in a circumferential direction of the developing roller 26 and are determined with respect to the foregoing direction of rotation.

(1) Development Frame

As shown FIGS. 2 and 5, the development frame 25 has a right sidewall 45 and a left sidewall 46 which are positioned opposite each other at a space in a widthwise direction; and is formed so as to have the shape of a box extending in its widthwise direction. The previously-described opening 29 is formed in a rear side of the development frame 25. The opening 29 has a substantially-rectangular shape elongated in its widthwise direction when viewed from the rear, and is formed in an area on the development frame 25 between a rear end of the right sidewall 45 and a rear end of the left sidewall 46.

As shown in FIG. 3, a shaft support groove 47 cut from a rear edge of the right sidewall to its front is formed in the right sidewall 45.

The shaft support groove 47 includes an entrance groove 48 extending from the rear edge of the right sidewall 45 in a substantially-horizontal direction and a guide groove 49 extending from the entrance groove 48 and obliquely bent up and to the front. The deepest position 50 (the upper edge) of the guide groove 49 serves as a secured position for the developing roller shaft 31.

Although not described in detail, the shaft support groove 47 analogous to that formed in the right sidewall 45 is formed also in the left sidewall 46 (see FIG. 5A).

Screw fastening holes 58 are opened in the right sidewall 45 and the left sidewall 46 forward of the corresponding shaft support grooves 47.

As shown in FIGS. 4 and 5A, a seal mount 51, which extends from an inner side surface of the right sidewall 45 toward the inner position in its widthwise direction, is provided around the opening 29 of the development frame 25. Specifically, the seal mount 51 is disposed outside the opening 29 of the development frame 25 in its widthwise direction.

As shown in FIG. 4, the seal mount 51 is formed so as to substantially have the shape of a forwardly-curved, recessed bow when viewed from the widthwise direction. The seal mount 51 has a lower mount 52 serving as an example of an opposing area to which a side seal 61 (to be described later) is to be bonded as an example of a developing agent leakage prevention member and an upper mount 53 to which the upper seal 62 (to be described later) is to be bonded.

The lower mount 52 is formed so as to have a curved shape extending along an outer circumferential surface of the developing roller 26 (specifically the rubber roller 32). The lower mount 52 is formed so as to be split into an upper surface 52A extending in a substantially-vertical direction at a front side and a rear surface 52B extending in a substantially-longitudinal direction at a rear side, with a shaft insertion portion 54 of the development frame 25, into which the supply roller shaft 41 is to be inserted, being sandwiched between the upper and lower surfaces.

The upper mount 53 is adjacent to an upper surface 52A of the lower mount 52 and recessed toward the front from the upper surface 52A, and is formed so as to have a substantially-C-shaped profile when viewed from the side. Specifically, a step 55 is formed between the lower mount 52 and the upper mount 53.

Although not described in detail, the seal mount 51 (see FIG. 5A) analogous to that formed on the right sidewall 45 is formed also on the left sidewall 46. Thus, the seal mount 51 is positioned on both sides of the opening 29 in the development frame 25 in its widthwise direction (see FIG. 5A). Moreover, the lower mounts 52 of the respective seal mounts 51 oppose, from the front at a space, corresponding ends of the developing roller 26 (the rubber roller 32) in its widthwise direction.

As shown in FIGS. 4 and 5A, the development frame 25 has, along an upper edge of the opening 29, a support wall 56 that supports the layer thickness regulation blade 27. The support wall 56 is laid along the upper edge of the opening 29 in its widthwise direction. Both ends of the support wall 56 in its widthwise direction are positioned adjacent to positions above the respective upper mounts 53 (see FIG. 4). Further, as shown in FIG. 5A, upper ends of both ends of the support wall 56 in its widthwise direction bulge rearwardly, and tapped holes 57 are formed in respective bulging portions.

(2) Side Seal

FIGS. 6A to 6D are schematic cross-sectional views of a side seal. FIG. 6A shows a state achieved before attachment of the side seal to the development frame. FIG. 6B shows a state (an exemplary embodiment) achieved after the side seal has been attached to the development frame. FIG. 6C shows a state (a modification) in which the side seal is attached to the development frame. FIG. 6D shows a state (a comparative example) in which the side seal is attached to the development frame.

As shown in FIGS. 4 and 5A, the development frame 25 is provided with the pair of side seals 61 in order to prevent leakage of toner held on the developing roller 26 to the outside of the development frame 25 from the outer circumferential surfaces of both ends of the developing roller 26 in its widthwise direction.

As shown in FIG. 6A, the side seal 61 includes a first layer 63, a second layer 64, and an adhesive layer 70 with reference to a state achieved before attachment of the side seal to the development frame 25.

First, the second layer 64 is formed so as to have the shape of a strip-like sheet having a thickness (of; for instance, 3 to 4 mm). The second layer 64 is made of an elastic foaming material, such as urethane sponge and; more specifically, high-density microcell urethane foam (Trade Name: PORON manufactured by Rogers Inoac Corporation).

The first layer 63 is formed from a felt made of Teflon (Registered Trademark) felt, and the like. Although the first layer 63 is identical in shape with the second layer 64, the first layer is thinner than the second layer 64. The first layer 63 is arranged while remaining superimposed on the second layer 64, and is affixed to the surface (a second opposing surface 64A to be described later) of an elastic foaming material in the second layer 64.

The adhesive layer 70 is a layer for affixing the first layer 63 to the second layer 64 and corresponds to a layer of; for instance, a double-sided tape. The adhesive layer 70 is interposed between the first layer 63 and the second layer 64, and partially bond a surface (called a first opposing surface 63A) of the first layer 63 opposing the second layer 64 to a surface (called a second opposing surface 64A) of the second layer 64 opposing the first layer 63 in such a manner that unbonded areas X, where the first and second opposing surfaces are not bonded together, are formed. For convenience of explanation, the unbonded areas X are conspicuously illustrated in FIG. 6.

As shown in FIG. 6B, such a side seal 61 is affixed to each of the lower mounts 52 (see also FIGS. 4 and 5A) of the respective seal mounts 51 of the right and left sidewalls 45 and 46. Specifically, the second layer 64 of the side seal 61 is affixed to the upper surface 52A and the rear surface 52B of the lower mount 52 so as to extend therebetween by way of a double-sided tape. In this state, the side seals 61 are placed in a curved fashion along outer circumferential surfaces of the rubber roller 32 between both ends of the developing roller 26 (specifically the rubber roller 32) in its widthwise direction and the respective lower mounts 52 disposed at both widthwise ends of the development frame 25 arranged so as to oppose both widthwise ends of the developing roller 26. Specifically, in the respective side seals 61, the first layers 63 contact outer circumferential surfaces of both ends (specifically corresponding both ends in the widthwise direction) of the developing roller 26 in its widthwise direction, and the second layers 64 contact the lower mounts 52 of the corresponding seal mounts 51. The side seals 61 are pressed against the respective lower mounts 52 (see FIG. 4) by the rubber roller 32. In this state, the side seals 61 have, in a pressed direction, two-thirds or less of the thickness achieved when the side seals are not pressed against the rubber roller 32. The first layers 63 are thereby brought into close contact with both ends of the outer circumferential surfaces of the developing roller 26 in its widthwise direction. Therefore, when the developing roller 26 rotates, the first layers 63 come into slidably contact with both ends of the outer circumferential surfaces of the developing roller 26 in its widthwise direction, thereby accordingly preventing leakage of toner to the outside in the widthwise direction from an area on the outer circumferential surface of the developing roller 26 sandwiched between the first layers 63 of the left and right side seals 61.

The foregoing adhesive layer 70 completely bonds the surface of the first layer 63, which opposes the second layer 64 in an area 63B of the first layer that contacts an outer circumferential surface of the developing roller 26, to the surface (the second opposing surface 64A) of the second layer 64 opposing the first layer 63. In this state, as shown in FIGS. 6B and 6C, the foregoing unbonded area X is produced in at least one of both ends of the first opposing surface 63A and the second opposing surface 64A in the direction of rotation of the developing roller 26 (see an arrow of a dotted line in the drawing). Specifically, in FIG. 6B, the unbonded area X is formed at both the upper end of the side seal 61 (i.e., a downstream end in the direction of rotation of the developing roller 26) and the rear end of the same (an upstream end in the direction of rotation of the developing roller 26). In FIG. 6C, the unbonded area X is formed at the rear end of the side seal 61. The side seal 61 (see FIG. 6B), in which the unbonded area X is formed at both the upper and rear ends of the side seal, is applied to the exemplary embodiment.

(3) Upper Seal

As shown in FIGS. 4 and 5A, the development frame 25 is provided with an upper seal 62 for preventing leakage of the toner held by the developing roller 26 from a rear side (the front side) of the layer thickness regulation blade 27.

The upper seal 62 is formed so as to have the shape of a substantially-C-shaped sheet, which is thicker than the side seal 61 (e.g., 5.0 to 6.0 mm), when viewed from the rear. The upper seal 62 is made of an elastic foaming material, such as urethane sponge, analogous to that of the second layer 64 of the side seal 61 (see FIGS. 6A to 6D).

The upper seal 62 is affixed so as to extend from the support wall 56 to the upper mounts 53 (see FIG. 4) of the right and left sidewalls 45 and 46 by way of a double-sided tape. Specifically, the upper seal 62 is provided on the surface (rear surface) of the support wall 56 (except the areas where the tapped holes 57 are provided) along its widthwise direction, as well as being continually provided, at both ends in its widthwise direction, on the upper mounts 53 of the right and left sidewalls 45 and 46. The upper seal 62 is thereby positioned among the support wall 56 of the development frame 25, the upper mounts 53, and the layer thickness regulation blade 27.

Both ends of the upper seal 62 in its widthwise direction are placed above both side seals 61; namely, adjacent to the downstream sides of the side seals 61 with respect to the direction of rotation of the developing roller 26 (see the arrow of the dotted line in FIG. 4). Thus, rear sides of the lower edges of both ends of the upper seal 62 in its widthwise direction remain in contact with front portions of the upper edges of the side seals 61 (specifically an area in the upper unbonded area X shown in FIG. 6B). In other word, the upper seal 62 remains in contact with the side seals 61 within the upper unbonded area X.

(4) Layer Thickness Regulation Blade

As shown in FIG. 5B and described above, the layer thickness regulation blade 27 has the flexible leaf spring member 33 and the pressure contract rubber 34 provided at a lower end of the leaf spring member 33.

The leaf spring member 33 is formed so as to have the shape of an elongated thin plate, when viewed from the rear, which extends in its widthwise direction to locations where the leaf spring member overlaps portions of the upper seal 62 (see FIG. 5A) located at both ends of the opening 29 in its widthwise direction.

Further, mount holes 65 are opened in upper positions at both ends of the leaf spring member 33 in its widthwise direction. Moreover, notches 66, which are upwardly cut from a lower edge and which have a rectangular shape when viewed from the rear, are formed at slightly inner positions from both ends of the leaf spring member 33 in its widthwise direction.

Front seals 67 are provided at lower positions on both ends of the leaf spring member 33 in its widthwise direction between both side edges of the leaf spring member in its widthwise direction and the notches 66.

The front seals 67 are intended for preventing leakage of the toner held on the developing roller 26 to the outside of the development frame 25 from a surface side (a rear surface side) of the layer thickness regulation blade 27 at its respective ends in the widthwise direction. The front seals are formed so as to have the shape of a substantially-rectangular sheet, which is thinner than the side seal 61 (e.g., 1.5 to 2.0 mm), when viewed from the rear. The front seals 67 are made of an elastic foaming material, such as urethane sponge, as are the second layers 64 of the side seals 61 (see FIGS. 6A to 6D) and affixed to the leaf spring member 33 by way of a double-sided tape.

The pressure contact rubber 34 is made of elastic rubber such as insulating silicone rubber so as to have a rectangular cross-sectional profile projecting toward the developing roller 26 (see FIG. 1). The pressure contact rubber 34 is provided at the lower end of the leaf spring member 33 so as to extend along its widthwise direction up to locations where the rubber contacts both front seals 67.

As shown in FIG. 4, an upper side of the leaf spring member 33 is arranged along the support wall 56, and fastening screws 68 are inserted into the respective mount holes 65 of the leaf spring member 33 (see FIG. 5B) and further screw-engaged with the tapped holes 57 of the support wall 56 (see FIG. 5A), whereupon the layer thickness regulation blade 27 is fastened to the development frame 25.

At the time of fastening of the layer thickness regulation blade 27, the leaf spring member 33 is nipped from the front and the rear by the reinforcement member 69 and secured to the support wall 56 by the fixing screws 68 in conjunction with a reinforcement member 69.

When viewed from the rear, both ends of the leaf spring member 33 in its widthwise direction overlap the upper seal 62 placed on the upper mounts 53, and are positioned adjacent to downstream sides of the side seals 61 with respect to the direction of rotation of the developing roller 26 (see the arrow of the dotted line in FIG. 4). When viewed from the rear, the front seals 67 overlap the upper seal 62 placed on the upper mounts 53 by way of the leaf spring member 33, and are positioned adjacent to the downstream sides of the side seals 61 with respect to the direction of rotation of the developing roller 26. At this time, lower edges of the front seals 67 remain in contact with rear portions of the upper edges of the side seals 61 (the upper unbonded areas X shown in FIG. 6B). More specifically, the lower edges of the front seals 67 and lower edges of areas of the leaf spring member 33 of the layer thickness regulation blade 27 where the front seals 67 are attached remain in contact with the side seals 61 from above within the upper unbonded areas X shown in FIG. 6B. Put another way, the layer thickness regulation blade 27 (see an area of a dotted line shown in FIG. 6B) remains in contact with the side seals 61 within the upper unbonded areas X.

As mentioned above, front portions of the upper ends of the side seals 61 (the upper unbonded areas X) remain in contact with the upper seal 62 as shown in FIG. 4, and rear portions of the upper ends remain in contact with the front seals 67 and the layer thickness regulation blade 27.

(5) Developing Roller

As shown in FIG. 5C, the developing roller 26 has the developing roller shaft 31 and the rubber roller 32. Both axial (widthwise) ends of the developing roller shaft 31 lie open to the outside from the rubber roller 32. As will be described in detail later, both ends are received by both shaft support grooves 47 (see FIG. 5A) of the development frame 25 and are rotatably supported by the right sidewall 45 and the left sidewall 46.

(6) Attachment of the Developing Roller to the Development Frame

Figure 7:
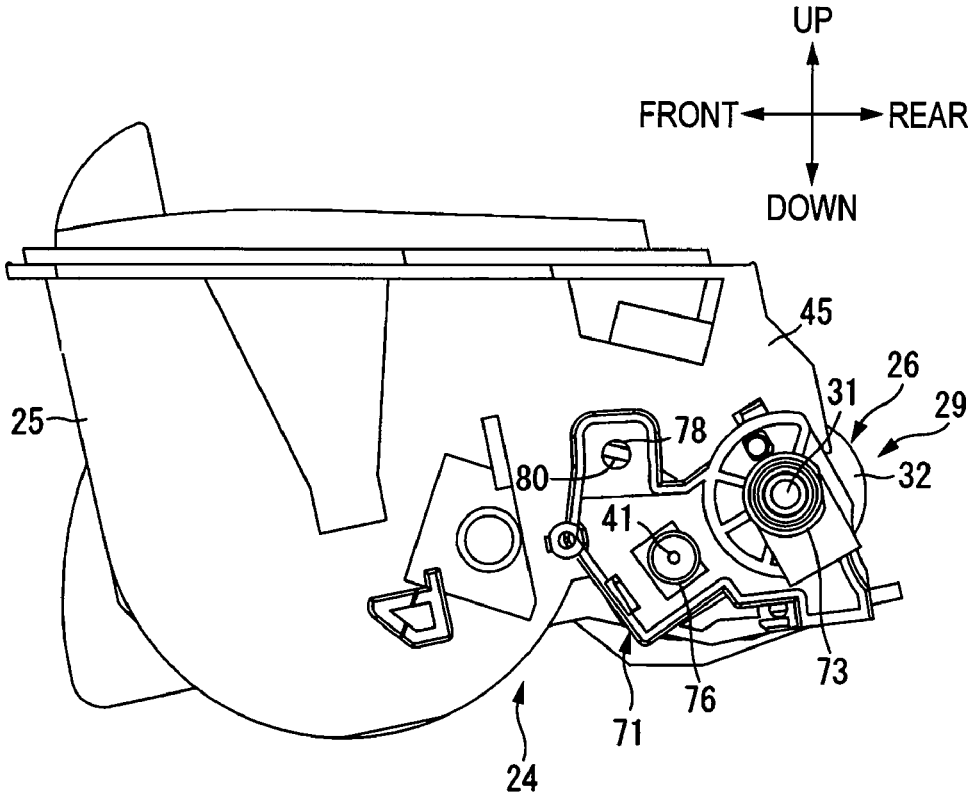
FIG. 7 is a right side view of a developing cartridge (in a state where a bearing member is attached).

FIG. 7 is a right side view of a developing cartridge (in a state where a bearing member is attached).

A method for attaching the developing roller 26 to the development frame 25 will now be described. In order to attach the developing roller 26 to the development frame 25, the layer thickness regulation blade 27 shown in FIG. 5B is attached to the development frame 25 shown in FIG. 5A. Subsequently, the developing roller 26 shown in FIG. 5C is positioned opposite the opening 29 such that both ends of the developing roller shaft 31 in its widthwise direction are inserted into boundary areas (see FIG. 3) between the entrance grooves 48 and the guide grooves 49 of both shaft support grooves 47.

As indicated by a phantom line in FIG. 3, both ends of the developing roller shaft 31 in its widthwise direction placed at the boundary areas between the entrance grooves 48 and the guide grooves 49 of the corresponding shaft support grooves 47 are obliquely moved up to the front at the guide grooves 49. When the developing roller shaft 31 is moved to the deepest positions 50 in the guide grooves 49 as mentioned above, the rubber roller 32 also presses the side seals 61 while obliquely moving up to the front as mentioned previously (see FIG. 4). Subsequently, both ends of the developing roller shaft 31 in its widthwise direction are placed in the deepest positions 50 of the corresponding guide grooves 49 as indicated by a solid line in FIG. 3, and are located at the deepest positions 50. At this time, both ends of the developing roller 26 (the rubber roller 32) in its widthwise direction oppose the corresponding lower mounts 52 from the rear with the side seals 61 sandwiched therebetween, as mentioned previously (see FIG. 4).

In this state, bearing members 71 shown in FIG. 7 are attached to both ends of the developing roller shaft 31 in its widthwise direction. The bearing member 71 has the shape of a flat plate that is thin in its widthwise direction. Details of the right and left bearing members 71 may differ from each other in terms of a geometry. A bearing portion 73, a screw attachment hole 78, and a shaft hole 76 are formed in each of the bearing members 71. The bearing portion 73, the screw attachment hole 78, and the shaft hole 76 are through holes that penetrate through the bearing member 71 in its thicknesswise direction (its widthwise direction). A screw 80 is inserted into the screw mount hole 78 of the bearing member 71 and screw-engaged to the screw fastening hole 58 (see FIG. 3). The bearing members 71 are thereby secured to the development frame 25. In this state, both ends of the developing roller shaft 31 in its widthwise direction are inserted into the bearing portions 73 of the corresponding bearing members 71 and fastened at the deepest positions 50 (see FIG. 3). The supply roller shaft 41 is inserted into the shaft holes 76 of the bearing members 71.

(7) Film

As shown in FIG. 4, the development frame 25 is equipped with a film 72 in regard to the developing roller 26. A PET sheet or a urethane rubber film is used for the film 72. The film 72 has a substantially-rectangular shape that is long in its widthwise direction, and obliquely extends up to the front. A lower end of the film 72 is affixed to an area of the development frame 25 lower than the opening 29 by use of a double-sided tape. In short, the film 72 is supported by the development frame 25. In this state, the film 72 contacts the outer circumferential surface of the developing roller 26 from below, thereby preventing leakage of toner from a space between the lower edge of the opening 29 of the development frame 25 and the developing roller 26. As indicated by a dotted line in FIG. 6B, the film 72 remains in contact with the side seals 61 in the rear unbonded areas X in this state. More specifically, the upper end of the film 72 remains in contact with the side seals 61 so as to go up the rear end of the first layer 63 at the side seals 61.

3. Advantages (1) In the developing cartridge 24, each of the side seals 61 has the first layer 63 that contacts outer circumferential surfaces of both ends of the developing roller 26 in its widthwise direction; the second layer 64 that contacts the lower mount 52 opposing either end of the developing roller 26 in its widthwise direction in the development frame 25; and the adhesive layer 70 interposed between the first layer 63 and the second layer 64, as shown in FIGS. 6A through 6C. The second layers 64 contacting the lower mounts 52 of the development frame 25 form base portions of the side seals 61. As shown in FIGS. 6B and 6C, when interposed between the outer circumferential surface of the developing roller 26 and the lower mounts 52, the side seals 61 are deformed from the state shown in FIG. 6A along the outer circumferential surface of the developing roller 26.

The adhesive layer 70 partially bonds the surface (the first opposing surface 63A) of the first layer 63 opposing the second layer 64 to the surface (the second opposing surface 64A) of the second layer 64 opposing the first layer 63 in such a way that the unbonded area X where the surfaces are not bonded together is produced.

Even when the second layers 64 forming the base portions of the side seals 61 are deformed, the first layers 63 are not deformed along with deformation of the second layers 64 in the unbonded areas X. In contrast, when the entireties of the first opposing surfaces 63A are bonded to the second opposing surfaces 64A as shown in FIG. 6D, the first layers 63 are deformed along with deformation of the second layers 64, thereby causing wrinkles Y in the first layers 63. As a result, gap Z arises between the first layers 63 and the outer circumferential surface of the developing roller 26 around the wrinkles Y. In this case, toner may leak by way of the gap Z.

Therefore, when the first opposing surfaces 63A and the second opposing surfaces 64A are partially bonded together as shown in FIGS. 6A through 6C, the first layers 63 are less susceptible to influence of deformation of the second layers 64 as compared with the case where the entireties of the first opposing surfaces 63A are bonded to the second opposing surfaces 64A (see FIG. 6D); hence, occurrence of the wrinkles Y (see FIG. 6D) in the first layers 63, which would otherwise be caused along with deformation of the second layers 64, can be prevented. When the entireties of the first opposing surfaces 63A are bonded to the second opposing surfaces 64A, it is easy to bond the first layers 63 to the second layers 64.

Namely, easy attachment of the side seals 61 is enabled while occurrence of wrinkles in the first layers 63 of the side seals 61 contacting the outer circumferential surface of the developing roller 26 is prevented, to thus hinder leakage of toner from the outer circumferential surface of the developing roller 26.

In a case where the diameter of the foregoing developing roller 26 ranges 12 mm to 25 mm, occurrence of wrinkles in the first layers 63 can be diminished further when the curvature radius of the lower mount 52 ranges 7 mm to 14 mm. Specifically, when the diameter of the developing roller 26 is 20 mm, the curvature radius of the lower mount 52 has a value of 11.1 mm. When the diameter of the developing roller 26 is 16 mm, the curvature radius of the lower mount 52 has a value of 9.1 mm. In another exemplary embodiment, when the diameter of the developing roller 26 is 25 mm, the curvature radius of the lower mount 52 has a value of 13.6 mm. When the diameter of the developing roller 26 is 12 mm, the curvature radius of the lower mount 52 has a value of 7.1 mm.

(2) As shown in FIGS. 6B and 6C, the unbonded area X is formed between the first opposing surface 63A and the second opposing surface 64A in at least one of both ends of the side seal 61 in the direction of rotation of the developing roller 26 (see the arrow of the dotted line in the drawing), so that the first opposing surface 63A and the second opposing surface 64A can be readily, partially bonded together.

In this case, even when wrinkles occur in interior positions of both ends of the first layers 63 in the direction of rotation of the developing roller 26 at the time of the developing roller 26 being brought into contact with the first layers 63, the wrinkles are moved to at least one of both ends, to thus be eliminated at the unbonded area X. As a consequence, occurrence of wrinkles in the first layers 63 can be prevented when compared with the case where the unbonded area X is not formed in either end of the developing roller 26 in its direction of rotation (where the unbonded area X is formed at interior positions at both ends).

(3) The adhesive layer 70 bonds the second opposing surface 64A to the surface of the first layer 63 opposing the second layer 64 in the area 63B of the first layer 63 to be brought into contact with the outer circumferential surface of the developing roller 26. Hence, the unbonded area X is not present between the second layer 64 and the area 63B of the first layer 63 to be brought into contact with the outer circumferential surface of the developing roller 26.

Therefore, when compared with the case where the unbonded area X is present between the second layer 64 and the area 63B of the first layer 63 to be brought into contact with the outer circumferential surface of the developing roller 26, the unbonded area X is extended along with rotation of the developing roller 26, thereby preventing separation of the first layer 63 from the second layer 64.

(4) As shown in FIG. 6B, contact members (see FIG. 4 also), such as the layer thickness regulation blade 27 and the film 72, contact the side seals 61 in the unbonded areas X; hence, the unbonded areas X are positioned. The unbonded areas X are thereby extended, to thus prevent separation of the first layer 63 from the second layer 64.

(5) The layer thickness regulation blade 27 that regulates the thickness of the toner held on the outer circumferential surface of the developing roller 26 doubles also as the above-mentioned contact member; hence, an attempt can be made to curtail the number of components.

(6) The film 72 that contacts the outer circumferential surface of the developing roller 26, thereby preventing leakage of toner from a space between the edges of the opening 29 of the development frame 25 and the developing roller 26 doubles also as the contact member; hence, an attempt can be made to curtail the number of components.

4. Modifications

The embodiment exemplifies the monochrome printer. However, the present invention can also be applied to a color printer.

Although the photosensitive drum 21 is exposed to laser generated by the scanner unit 12, the photosensitive drum 21 may also be exposed by use of an LED in lieu of the scanner unit 12.

As described above, there is provided a developing device that stores a developing agent and that includes a housing with an opening, a developing agent carrier which is rotatably supported at the opening by the housing and which holds on its outer circumferential surface the developing agent, and developing agent leakage prevention members which are provided in the housing outside the opening in a longitudinal direction of the developing agent carrier and which prevent leakage of the developing agent from a space between opposing areas opposing both longitudinal ends of the developing agent carrier and outer circumferential surfaces of both longitudinal ends of the developing agent carrier, wherein each of the developing agent leakage prevention members has a first layer that contacts the outer circumferential surface of either longitudinal end of the developing agent carrier; a second layer that is superimposed on the first layer and that contacts the corresponding opposing area; and an adhesive layer that is interposed between the first layer and the second layer and that partially bonds an opposing surface of the first layer opposing the second layer to an opposing surface of the second layer opposing the first layer in such a way that an unbonded area where the opposing surfaces are not bonded together is produced.

Also, in the exemplary embodiment, the unbonded area is formed between the opposing surface of the first layer opposing the second layer and the opposing surface of the second layer opposing the first layer in at least one of both ends of the developing agent leakage prevention member in a direction of rotation of the developing agent carrier.

Moreover, in the exemplary embodiment, the adhesive layer bonds the opposing surface of the second layer opposing the first layer to the opposing surface of the first layer opposing the second layer in a portion of the first layer to be brought into contact with the outer circumferential surface of the developing agent carrier.

Also, the exemplary embodiment includes a contact member to be brought into contact with the developing agent leakage prevention member in the unbonded area.

Also, in the exemplary embodiment, the contact member is a regulation member that is supported by the housing and that regulates a thickness of the developing agent held on the outer circumferential surface of the developing agent carrier.

Also, in the exemplary embodiment, the contact member is a film that is supported by the housing and that contacts the outer circumferential surface of the developing agent carrier, thereby preventing leakage of the developing agent from a space between an edge of the opening in the housing and the developing agent carrier.

According to the exemplary embodiment, each of the developing agent leakage prevention members, which prevents leakage of a developing agent from outer circumferential surfaces of both longitudinal ends of the developing agent carrier, has a first layer that contacts the outer circumferential surface of either longitudinal end of the developing agent carrier; a second layer that contacts the corresponding opposing area opposing either longitudinal end of the developing agent carrier in the housing; and an adhesive layer interposed between the first layer and the second layer. The second layer contacting the opposing area of the housing form a base portion of each of the developing agent leakage prevention members. Each of the developing agent leakage prevention members is interposed between the outer circumferential surface of the developing agent carrier and the opposing area and becomes deformed along the outer circumferential surface of the developing agent carrier.

The adhesive layer partially bonds an opposing surface of the first layer opposing the second layer to an opposing surface of the second layer opposing the first layer in such a way that an unbonded area where the opposing surfaces are not bonded together is produced.

Therefore, even when the second layers forming the base portions of the developing agent leakage prevention members are deformed, the first layers are not deformed along with deformation of the second layers in the unbonded areas. When compared with a case where the entireties of the first layers opposing the respective second layers are bonded to the opposing areas of the second layers opposing the respective first layers, the first layers are less susceptible to the influence of deformation of the second layers; hence, occurrence of wrinkles in the first layers, which would otherwise arise along with deformation of the second layers, can be prevented. Moreover, when compared with a case where the entireties of the first layers opposing the respective second layers are bonded to the opposing surfaces of the second layers opposing the respective first layers, bonding of the first layers to the second layers is easier.

Specifically, it is possible to readily attach the developing agent leakage prevention members while occurrence of wrinkles in the first layers, which contact the outer circumferential surface of the developing agent carrier, in the developing agent leakage prevention members is prevented, to thus hinder leakage of the developing agent from the outer circumferential surface of the developing agent carrier.

Further, according to the exemplary embodiment, the unbonded area is formed between the opposing surface of the first layer opposing the second layer and the opposing surface of the second layer opposing the first layer in at least one of both ends of the developing agent leakage prevention member in a direction of rotation of the developing agent carrier, whereby the opposing surfaces of the first layers opposing the second layers and the opposing surfaces of the second layers opposing the first layers can be readily, partially bonded together.

In this case, even when wrinkles occur at interior positions of both ends of the first layers in the direction of rotation of the developing agent carrier at the time of the developing agent carrier being brought into contact with the first layers, the wrinkles are moved to at least one of both ends, to thus be eliminated at the unbonded area. As a consequence, occurrence of wrinkles in the first layers can be prevented when compared with the case where the unbonded area is not formed in either end of the developing agent leakage prevention member in a direction of rotation of the developing agent carrier.

According to the exemplary embodiment, the adhesive layer bonds the opposing surface of the second layer opposing the first layer to the opposing surface of the first layer opposing the second layer in a portion of the first layer to be brought into contact with the outer circumferential surface of the developing agent carrier. Hence, the unbonded area is not present between the portions of the first layers contacting the outer circumferential surface of the developing agent carrier and the second layers.

Therefore, when compared with the case where the unbonded area is present between the second layer and the area of the first layer to be brought into contact with the outer circumferential surface of the developing agent carrier, the unbonded area is extended along with rotation of the developing agent carrier, thereby preventing separation of the first layer from the second layer.

According to the exemplary embodiment, the contact member is brought into contact with the developing agent leakage prevention member in the unbonded area, and hence the unbonded area is positioned. The unbonded area is thereby extended, to thus prevent separation of the first layers from the second layers.

Further, according to the exemplary embodiment, a regulation member that regulates a thickness of the developing agent held on the outer circumferential surface of the developing agent carrier doubles also as the contact member; hence, an attempt can be made to curtail the number of components.

Further, according to the exemplary embodiment, a film that contacts the outer circumferential surface of the developing agent carrier, to thus prevent leakage of the developing agent from a space between an edge of the opening in the housing and the developing agent carrier, doubles also as the contact member. Hence, an attempt can be made to curtail the number of components.

What is claimed is:

1. A developing device comprising:

a housing that stores developing agent and has an opening;

a developing agent carrier that is rotatably supported by the housing, the developing agent carrier holding the developing agent on an outer circumferential surface of the developing agent carrier;

a developing agent leakage prevention member that is provided in the housing outside the opening in a longitudinal direction of the developing agent carrier, the developing agent leakage prevention member preventing leakage of the developing agent from a space between an opposing area of the housing opposing a longitudinal end of the developing agent carrier and the outer circumferential surface of the longitudinal end of the developing agent carrier, wherein the developing agent leakage prevention member comprising:

a first layer that is configured to contact the outer circumferential surface of the longitudinal end of the developing agent carrier;

a second layer that is superimposed on the first layer and is configured to contact the opposing area of the housing; and an adhesive layer that is interposed between the first layer and the second layer, the adhesive layer partially bonding a first opposing surface of the first layer opposing the second layer to a second opposing surface of the second layer opposing the first layer such that an unbonded area where the first opposing surface and the second opposing surface are not bonded together is produced.

2. The developing device according to claim 1, wherein the unbonded area is formed between the first opposing surface and the second opposing surface in at least one of both ends of the developing agent leakage prevention member in a rotation direction of the developing agent carrier.

3. The developing device according to claim 1, wherein the adhesive layer bonds the second opposing surface to the first opposing surface in a portion in which the first layer contacts with the outer circumferential surface of the developing agent carrier.

4. The developing device according to claim 1, further comprising:

a contact member that is configured to contact with the developing agent leakage prevention member in the unbonded area.

5. The developing device according to claim 4, wherein the contact member is a regulation member that is supported by the housing and that regulates a thickness of the developing agent held on the outer circumferential surface of the developing agent carrier.

6. The developing device according to claim 4, wherein the contact member is a film that is supported by the housing and that contacts with the outer circumferential surface of the developing agent carrier, thereby preventing leakage of the developing agent from a space between an edge of the opening in the housing and the developing agent carrier.

* * * * *